United States Patent [19]

Vilas-Boas

[11] Patent Number: 5,060,801

[45] Date of Patent: Oct. 29, 1991

[54] PACKING BOLSTER, CONTAINER FOR SUCH A BOLSTER

[75] Inventor: Jean-Claude Vilas-Boas, Sannois, France

[73] Assignee: Bull, S.A., Paris, France

[21] Appl. No.: 301,907

[22] Filed: Jan. 26, 1989

[30] Foreign Application Priority Data

Jan. 26, 1988 [FR] France ..... 88 00879

[51] Int. Cl.[5] ..... B65D 81/02; B65D 85/30

[52] U.S. Cl. ..... 206/523; 206/503; 206/509; 206/586; 229/DIG. 1

[58] Field of Search ..... 206/390, 523, 522, 586, 206/588, 590, 591, 592, 594, 499, 503, 509; 220/334; 229/DIG. 1, DIG. 4

[56] References Cited

U.S. PATENT DOCUMENTS

| | | | |
|---|---|---|---|
| 2,720,967 | 10/1955 | Wilson | 206/499 |
| 2,874,826 | 2/1959 | Matthews et al. | 206/522 |
| 3,435,946 | 4/1969 | Sobek et al. | 206/523 |
| 3,530,213 | 9/1970 | Belle Isle | 206/523 |
| 3,546,055 | 12/1970 | Spertus | 206/523 |
| 3,564,811 | 2/1971 | Freeman | 206/523 |
| 3,565,243 | 2/1971 | Freeman | 206/523 |
| 3,695,421 | 10/1972 | Wood | 206/523 |
| 3,717,247 | 2/1973 | Moore | 206/390 |
| 3,854,650 | 12/1974 | Hanaue | 206/523 |
| 3,889,743 | 6/1975 | Presnick | 206/522 |
| 3,904,033 | 9/1975 | Haerr | 220/339 |
| 4,027,064 | 5/1977 | Bussey, Jr. | 206/523 |
| 4,166,875 | 9/1979 | Bussey, Jr. | 206/523 |
| 4,268,555 | 5/1981 | Kantz | 229/DIG. 4 |
| 4,284,227 | 8/1981 | Corey | 229/DIG. 4 |
| 4,700,832 | 10/1987 | Champ | 206/523 |
| 4,752,002 | 6/1988 | Takahashi et al. | 206/390 |
| 4,909,432 | 3/1990 | Nagata | 229/DIG. 4 |

FOREIGN PATENT DOCUMENTS

| | | | |
|---|---|---|---|
| 665574 | 9/1938 | Fed. Rep. of Germany | 206/322 |
| 1224493 | 3/1971 | United Kingdom | 206/586 |

*Primary Examiner*—David T. Fidei

*Attorney, Agent, or Firm*—Kerkam, Stowell, Kondracki & Clarke

[57] ABSTRACT

A bolster is provided for holding and protecting a product in a package which is made of plastic material, such as polyethylene or polyurethane, the bolster being of continuous form and cut to the desired dimension so as to at least partiallly surround the product, and in cross section includes lateral extending retention portions extending in the direction perpendicular to the plane in which the length of the bolster is located, the retention portions forming at least one groove therebetween intended to receive and laterally hold the product, the bolster further having at least one first contact face adapted to bear on an inside wall of the package, and having a second contact face opposite the face of the bolster in which the groove is formed of a mating shape to the first contact face so as to permit nesting-type stacking of the bolsters in storage, the second contact face being intended to come into contact with the inside walls of the package, the second contact face further including slits in the solid material that facilitate folding of the bolster to enable it to surround the product, each of the slits extending over the entire available width of the bolster, and preferably taking the form of a captial T.

6 Claims, 4 Drawing Sheets

PACKING BOLSTER, CONTAINER FOR SUCH A BOLSTER

BACKGROUND OF THE INVENTION

1. Field of the Invention

The present invention relates to a packing bolster and a container for such a bolster, as well as to a packaging method using such a bolster. It is used in the packing and packaging of solid but fragile objects for storage and shipping.

2. Description of the Related Art

Packing bolsters are known in the prior art that are placed between the packaged product and the box intended to contain it. In present practice, it is within the competence of one skilled in the art to use angular bolsters, which can damp overly sudden acceleration (principally, shocks) and keep the packaged product spaced apart from its container. Such bolsters are made of synthetic materials, such as polystyrene. The main disadvantage of wedge bolsters is that they occupy a long space and are virtually impossible to insert automatically.

Another proposal to improve bolstering and especially the manipulation of the bolsters uses half-shells of plastic materials of a completely enveloping shape and is more easily manipulable. However, when it introduced into the box, the shells must be held by the free hand, and they have a tendency to move away from the product to be bolstered, so that in an extreme case they might allow the product to escape.

A disadvantage common to both of the above provisions is that it requires considerable storage volume prior to use. The bolsters in fact remain in the warehouse before being sent over the transfer line, and the volume that they occupy is unavailable for other activities of the business.

SUMMARY OF THE INVENTION

The present invention makes it possible to overcome the disadvantages of the prior art. Its first object is to reduce the storage volume in the warehouse prior to use on the transfer line.

A second object of the present invention is to enable virtually complete automation, thus on the one hand saving handling by humans and on the other avoiding the risks of error in expensive handling operations.

To these ends, the invention relates to a packing bolster intended to be introduced into a package for protecting a product to be packaged. It is characterized in principle by the fact that it is made of a plastic material in continuous form intended to be cut to the dimension necessary for at least surrounding the product. Moreover, once it has been installed, its cross section includes portions for retaining the product in a direction perpendicular to the plane in which the length of the bolster is located.

The invention also relates to the storage means for a bolster designed as described above. Such a means includes a device for unwinding a length of bolster on demand while the remainder of the bolster remains in compressed form so as to limit the storage volume.

The invention further relates to an automatic packaging method, which is characterized in that the bolster is disposed above the box, drawn and then cut to the desired length; then a product to be packaged is disposed above the box comprising the container and wedge and applied in such a manner as to be installed in the container, the placement taking place by gravity.

BRIEF DESCRIPTION OF THE DRAWINGS

Further advantages and characteristics of the present invention will become more apparent with the aid of the ensuing detailed description, referring to the drawings.

DESCRIPTION OF THE PREFERRED EMBODIMENTS

In this description, the term "box" is used as an equivalent to "package", and more generically, "container". Particularly in a preferred embodiment, boxes of preshaped cardboard are envisioned.

Figure 1:
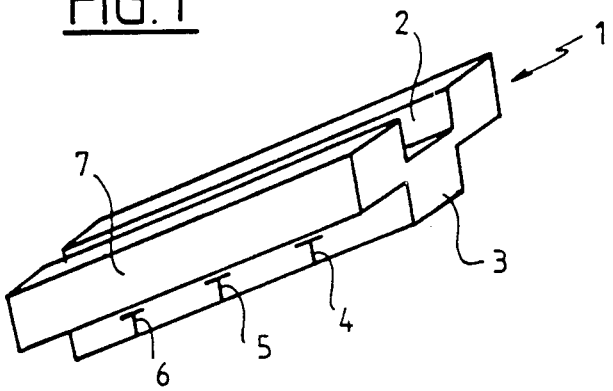
FIG. 1 is a diagram of a first embodiment of a bolster according to the invention.
Figure 12:
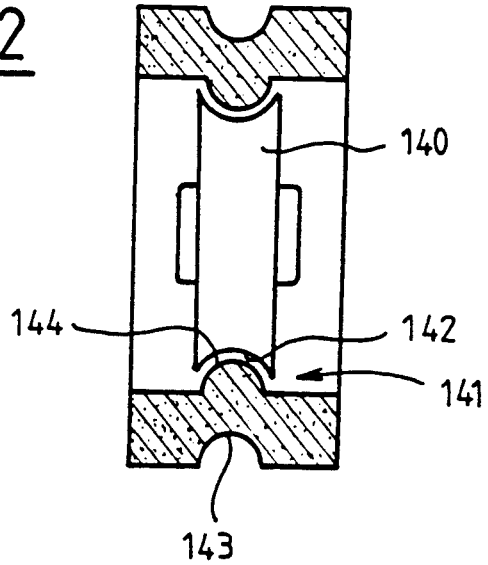
FIG. 12 is a diagram in section of another exemplary embodiment of the invention, for a bolster of the first type.

In FIG. 1, a first exemplary embodiment of a bolster according to the invention is shown. A bolster of this kind is made in the form of an elongated strip intended to surround the product to be packaged. In a preferred embodiment, in order to produce an effect of lateral retention, the strip 1 is hollowed out, in a zone for receiving the product to be packaged, with a groove 2; the visible side 7 of the strip is intended to press against the lateral walls of a box or container. In an embodiment shown in FIG. 12, the face 142 of the product intended to come into contact with the reception zone 141 of the bolster is hollow in shape. It follows that the reception zone 141 of the bolster must be of a mating shape 144 of this face 142 of the product, so as to comprise a suitable retention means. Similarly, the mating shape 143 provided on the lower face of the bolster is adapted to the shape 144 of the reception zone.

To permit improved storage and good bolstering in the container, the bottom of the strip is extended by a mating shape 3 suitable for nesting perfectly into the groove 2. In this manner, the bolsters according to this embodiment can be stacked without losing space, while also making a stable stack in the packaging stations. Once the bolsters have been cut to length, they can be stored in a container the lid of which exerts a pressure that reduces their volume, if they are stacked.

Figure 6A:
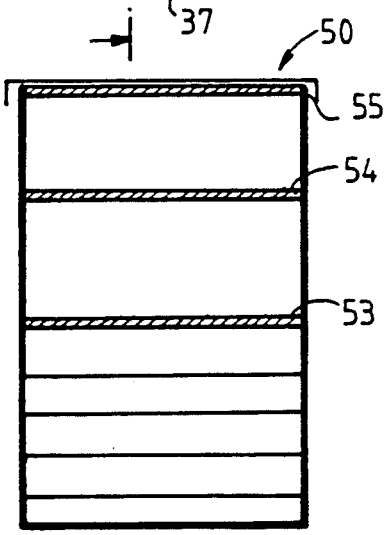
FIGS. 6*a* and *b* are a diagram of a storage means according to the invention.
Figure 6B:
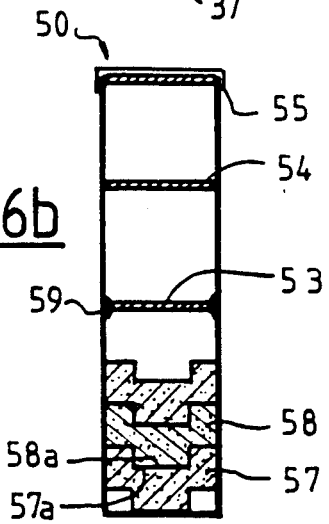

A storage of this type is shown in FIGS. 6*a* and 6*b*. A container 50 is made of sheet metal, with an opening toward the top. The container 50 includes a bottom at the beginning of which the bolsters, cut to the required dimensions, are piled. It should be noted that the first bolster 57 disposed at the bottom is squashed down in its area of elastic flexion, and that the groove 57*a* receives the mating shape 58*a* of the following bolster 58.

The container 50 receives the bolsters in a plurality of volumes limited by plates 53–55. These plates disposed in such a manner as to compress the already-stored bolsters; the inside wall includes means 59 for detent fixation, which make it possible to maintain the pressure on the stored volume even while the following volume is being filled or emptied.

Finally, a lid of the upper opening makes it possible to compress the final volume of bolsters stored and thus to keep a large number of bolsters on hand, ready for use, in a reduced volume.

In a preferred embodiment, the material of which the bolster is made is a polyurethane derivative, and the rate of volumetric compression reaches 80%.

In a preferred embodiment of the present invention, the storage of the bolsters is performed before the bolsters are cut to the desired dimensions. Contrary to the foregoing storage method, the band is stored in a roll and compressed such as to reduce its bulk further. In FIG. 7, a preferred embodiment of a container for band-type bolsters has been shown, prior to the operation of bolstering of the product to be packaged.

Figure 7A:
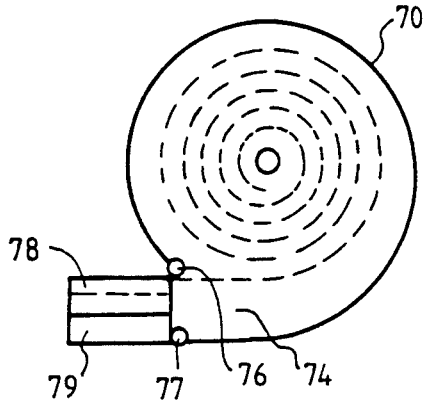
FIG. 7 is a diagram showing another storage means according to the invention.
Figure 7B:
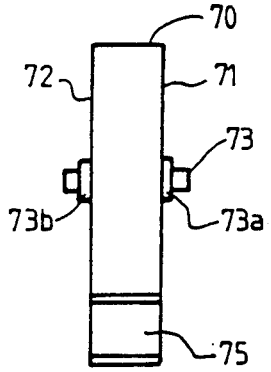

In FIG. 7*b*, the container comprises two lateral end plates 71 and 72, through which a shaft 73 passes that is mounted on bearings 73*a* and 73*b*. A means for accumulating the strip 74 is borne by the shaft 73 to the inside of the volume defined by the two end plates 71 and 72. The strip 74 shown in FIG. 7*a* is wound up in adjacent spirals; the mating shape 3 is nested in the throat 2 of the bolster shown in FIG. 1. In order to permit loading of the container, one of the end plates 71 or 72 is removable. One end of the "bolster" strip is introduced via the compression rollers 76 and 77 and is drawn until it is engaged within the means for fixation of the shaft 73.

In a preferred embodiment, the two end plates are joined by a solid circular form intended to keep the band wound inside its container compressed. One such form is embodied by a sheet of steel of a generally cylindrical shape, the lids of which are the end plates 71, 72.

In the reeling phase, the bottom of the container includes an opening 75 through which a desired length of bolster in strip form is drawn. Distribution is assured by two rollers 76 and 77 which prevent the strip from expanding excessively prior to leaving the container 70.

For better understanding of the invention, the free end of the strip serving as a bolster has been shown after having been cut to the desired length. It includes the throat 78 and the mating shape 79. In a general fashion, a bolster according to the invention is always such that its cross section is provided with portions for retaining the product. These portions are in the direction perpendicular to the plane in which one views the length of the bolster.

Returning to FIG. 1, in a preferred embodiment according to the invention, it should be noted that the lower portion of the bolster intended to come into contact directly with the walls of the package is provided with three slits 4–6 intended to improve the flexion of the bolster, which must fold around the product to be packaged. For polyurethane bolsters, these slits are obtained with heat by cutting with a blade. With other materials, the slits are made by molding.

In a preferred embodiment, each slit occupies the entire available width of the contact face and is in the form of a capital T. When the bolster is folded along the slit, the vertical edges of the slit move apart from one another, preventing the tearing that excessive displacement of the material at this location would cause. Instead, the horizontal part of the capital T deforms in an arc, acting as a hinge.

Figure 2:
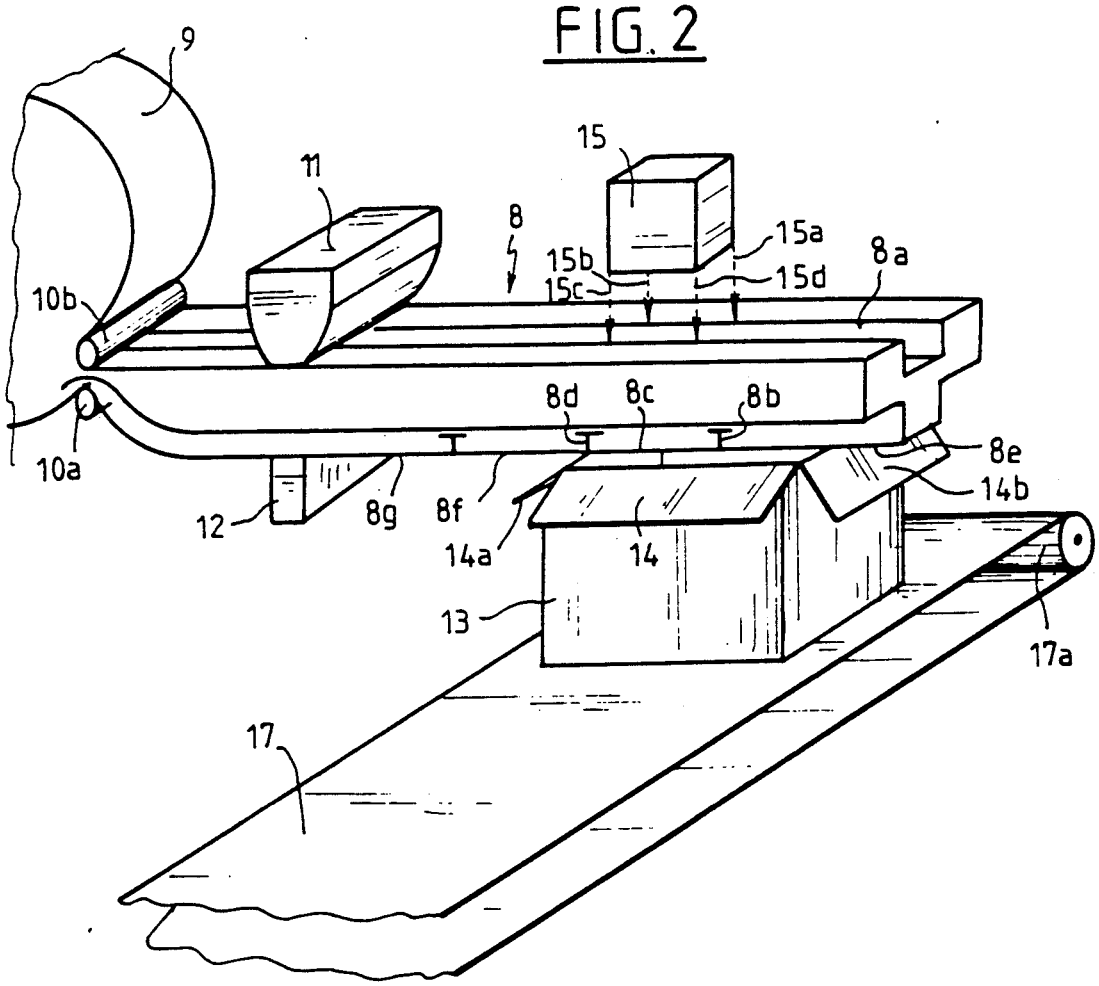
FIG. 2 is a diagram of part of a transfer line using the bolster, and the bolster unwinder according the invention.

In FIG. 2, a packaging line that can be automated completely with the means according to the invention has been shown. The bolster is stored in its container 9, and a length 8 is drawn out in such a way as to be located above the packing zone. Means 11–12 for cutting the strip are located such as to adapt the length of bolster drawn from the container 9 automatically to the requirements of the box and product that are present in the packing zone. In one embodiment, the cutting means include a motorized chisel 11 and an anvil 12 against which the base of the strip is pressed.

In the packing zone, a conveyor belt supplies a box 13 that an automatic device, not shown but within the competence of one skilled in the art to provide, pulls open with its flap 14. The box 13 rests by gravity on the conveyor belt, and its opening faces upward.

Above it, the bolster is disposed such that it is ready to enter into a good position in the box without additional manipulation. A product 15 of generally parallelepiped shape, transported by a different conveyor means, not shown but within the competence of one skilled in the art, is placed above the box and bolster. The product is deposited by gravity in the throat 8*a* in the direction of arrows shown at 15*a*–15*d*.

The placement can be guided by the handling robot in such a way as to improve the output of the line, compared with the case where only gravity is used to effect the placement of the product in the container.

In the case of a product having an element of symmetry, the planes defined by the straight lines 15*b*, 15*c* on the one hand and 15*d*, 15*a* on the other, cut the bolster between the hinges 8*b* and 8*d*, which in turn are in directions that pass to the inside of the box 13.

In this way, depositing the product in the groove 8*a* of the bolster 8 installs the product in the bolster, and wedges the bolster with the product inside the box without requiring supplementary centering.

At the end of the placement, the face 8*c* of the bolster is pressed against the bottom of the box 13, and the faces 8*d* and 8*f* are pressed against the side walls of the box 13 that is kept open. The face 8*g* of the bolster is now vertical, but since the wedge has left the packing zone empty, a robot can manipulate first the flap 14*a* and then the flap 14*b* so as to press the upper face of the product strongly into the continuous throat 8*a* of the free portion of the bolster.

At the end of the procedure, the belt 17 is unwound, which moves the filled box 13 away to banding means, not shown. Finally, a new length of strip is drawn from the container 9, and an empty box is brought up.

In another embodiment, the box or container is supplied in an unready form, that is, as a box of flat cardboard or a heat-shrinkable plastic film. This kind of embodiment is applicable to any packaging element, such as flat cardboard or a sheet of synthetic thermoformable resin, and shows that automation of the packaging process can be advanced still further.

Figure 3:
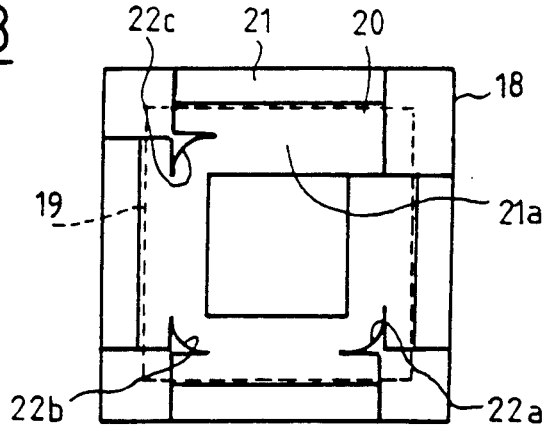
FIG. 3 is a sectional view of a package, a product and an installed bolster according to the invention.

In FIG. 3, a closed box has been shown in vertical section, containing a product packaged with the bolster and by the method according to the invention. The box 18 is closed, and the bolster 21 completely surrounds the product 19. The groove 21*a* can be seen, which permits lateral maintenance in the direction perpendicular to the plane of the drawing.

The hinges are three in number, that is, elements 22*a*, *b* and *c*. It should be noted that they include a central portion shaped as a highly curved arc and two linear edges on the side in the body of the bolster, which make it possible to avoid reflecting the internal strains resulting from the pronounced curvature to the outer edges of the bolster.

Figure 4:
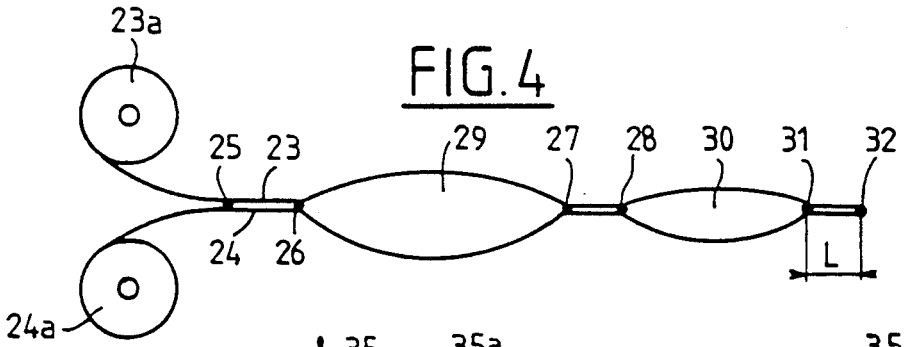
FIG. 4 is a diagram of a second embodiment of a bolster according to the invention.

In FIG. 4, a second embodiment of bolsters according to the invention is shown. Here a non-solid technology of inflating in which chains of bolstering cushions is used. To this end, the bolster is stored in two parts. The first part comprises two sheets of flexible material 23, 24. Each sheet can be stored separately from the other on drums 23*a* and 24*a*.

When a sufficient length of sheet has been drawn out, closure is performed by fixation of the two sheets to one another. Depending on the type of sheet, the fixation can be assured either by heat fusion, gluing, or by placement of rivets or other mechanical connectors.

In FIG. 4, heat fusion of sheets is shown along two bars 31–32 separated by a distance L.

The drawn-out length of each sheet may be different from one sheet to another, or from one cushion to another. In the example shown in FIG. 4, the drawn-out length of sheet 24 is greater than that of the sheet 23. This arrangement makes it possible to adapt the shape of the cushion to the position that each of them is to occupy in the box once the packing has been completed.

In the case of parallelepiped cushions, the sides perpendicular to those of FIG. 4 are made in the same manner. One skilled in the art will know how to adapt the closure operations to any kind of cushion shape.

Prior to the closure of the last free edge, an inflating agent is introduced, which may be a gas, a liquid or a plastic solid, which thus comprises the second part of the bolster according to the invention. One skilled in the art will select his materials as a function of the resistance and relative elasticity of the sheets 23 and 24 and of the inflating agent.

In a preferred embodiment, the inflating agent is a liquid with two bases or components. One such agent is known for example as in-situ or serial polyurethane foam. In such a system, the two components are stored in liquid form and are mixed in predetermined proportions so as to constitute a cushion of foam in air, inside the space made by the two sheets. This saves space by a factor of 50 to 180. In another embodiment, the filling of the cushion is assured automatically by pulverizing polystyrene so as to comprise a mass of balls or grains of various shapes. The increase in storage capacity is by a factor of about 50.

In this type of bolster according the invention, the bolster is continuous. It is made in the form of a linear chain of successive cushions of various forms but forms predetermined by the relative length of sheets drawn out at the top and bottom 23 and 24. In FIG. 4, two cushions 29 and 30 are made in closed form with the double fused seams 25, 26, 27., 28, 31, 32. The length L separating two successive cushions make it possible to adapt the chain to the shape of product to be packaged. Another function of the connecting zones of length L is to comprise a hinge between two cushions, to make it easy to encircle the product to be packaged.

It should be noted that the packaging method of the invention is equally applicable in the second type of bolster, of the two-part type, one part being in the form of sheets and the other in the form of an inflating agent. Enhanced automation is possible.

Figure 5A:
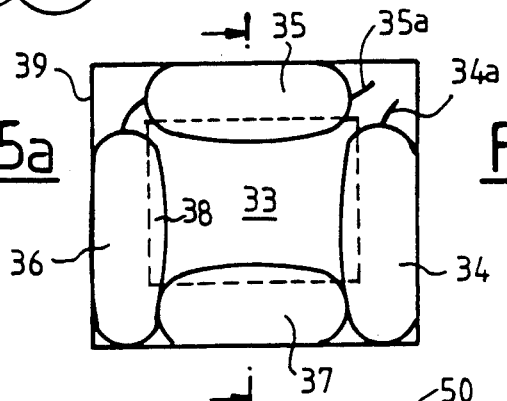
FIG. 5 is a sectional view of a package, a product and an installed bolster according to the invention.
Figure 5B:
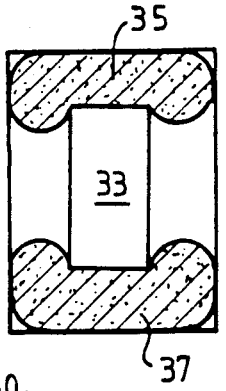

In FIGS. 5*a* and 5*b*, a closed box 39 is shown, after packing with a bolster of the second type and by the method of the invention. FIG. 5*a* is obtained by removing side wall of the box 37 for clarity, and FIG. 5*b* is a central section in a detail of 5*a*.

The packaged product 33 is surrounded completely by a chain of four cushions 34–37. Note the free ends 34*a* and 35*a* of the cushions 34 and 35, which are produced upon cutting of the chain cushions used in the packaging method according to the invention.

As in the first embodiment in which a solid bolster is used, the cushion 35 is pressed down when the box is closed with its upper flap. In FIG. 5*b*, the shape assumed by the cushions that largely surround the product 33 in the box 39 can be seen in section.

Figure 10:
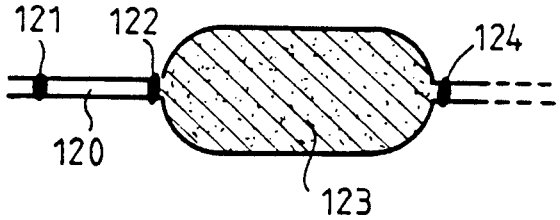
FIG. 10 is a diagram of another embodiment of a bolster according to the invention.

In another embodiment, shown in FIG. 10, the plastic film is in the form of a sleeve of indefinite length, and is fused between zones intended to comprise cushions. The same principle of cushion construction as before is maintained, by forming a first flat zone 120 defined by two fused seams 121 and 122, and then a cushion 123 made by the injection of an inflating agent closed with a soldered seam 124, the pattern being repeated as needed for packaging on the line.

Other forms of bolster may be imagined, so as to enable adapting the invention to any kind of packing of single or multiple products, whether of parallelepiped shape or of some other shape.

Figure 8:
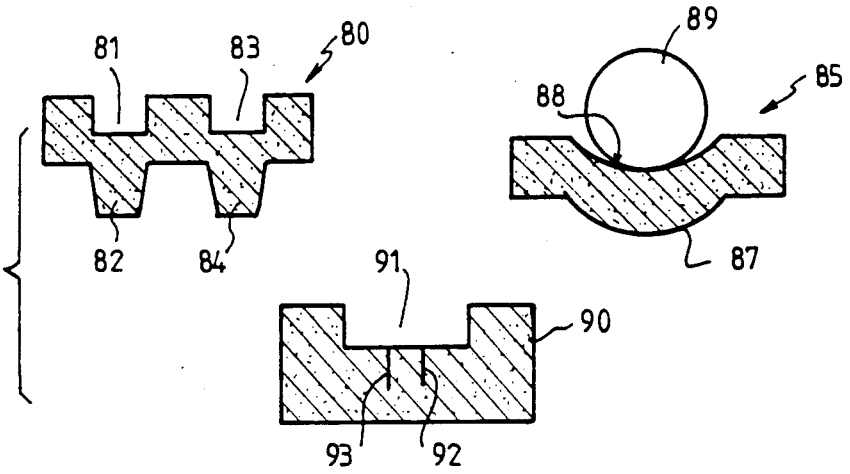
FIG. 8 is a set of possible shapes for a bolster of the first type according to the invention.

In particular, in FIG. 8, various possible shapes of bolsters have been shown in sections, with and without the product installed. The first bolster 80 includes two throats 81 and 83 which match the mating shape 82 and 84. One such bolster can receive two products side by side. The second bolster 85 includes a throat 88 of concave shape that matches the reciprocal mating shape 87. The product may thus have a concave shape of lesser curvature.

The third form 90 does not include a mating shape on its lower face (but this is not a requirement) but includes a throat 91 the bottom of which is provided with two slits 92 and 93 intended to permit any slight unevenness of the product to be accommodated in the bolster without undergoing an excessive deformation reaction.

Figure 9:
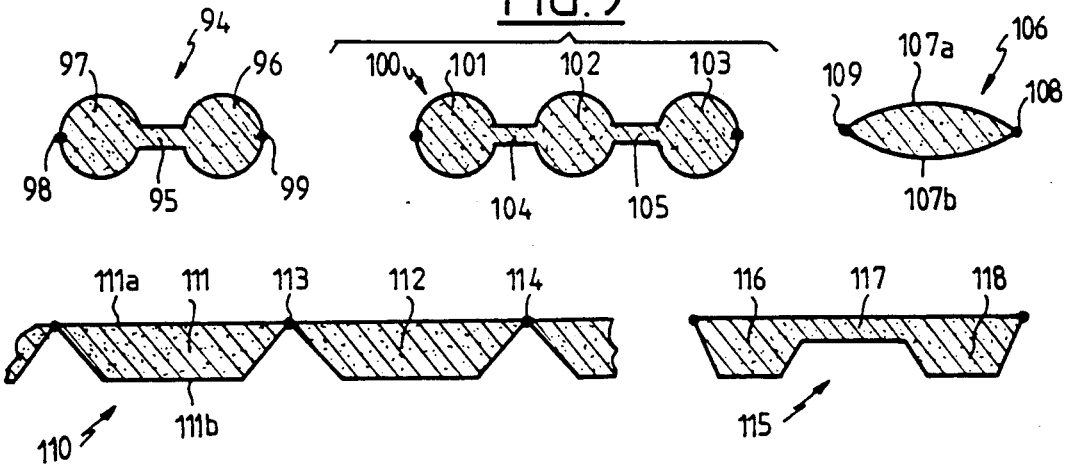
FIG. 9 is a set of possible shapes of bolsters of the second type according to the invention.

In FIG. 9, various possible shapes of bolsters of the second type, made of dual-component cushions, are shown in section with and without the product installed. The first bolster 94 is dumbbell-shaped, with two side cushions 96 and 97 and a connecting portion 95, the unit being filled with inflating agent. As before, the chain may be obtained by assembling two sheets at 98 and 99.

The chain 100 includes three cushions 101–103 joined by two elongated sections 104 and 105. The unit is filled with the filling agent.

The bolster 106 is a single cushion of biconvex lens shape, made of two sheets 107*a* and 107*b* joined by fusing at 108 and 109.

The bolster 110 comprises a chain of cushions 111, 112 . . . , the sheet 111*a* being extended to the maximum and the sheet 111*b* being thermoformed in such a way as to make a cushion of generally parallelepiped form.

The bolster 115 is similarly constructed, but the fused seams 113 and 114 of the preceding chain are replaced with sections 117 filled with inflating agent, like the actual cushions 116 and 118. However, the differences in volume distinguish the actual cushions (which are larger) from their connecting portions (which are small).

In FIG. 11, a certain number of package embodiments adapted to various situations are shown.

Figure 11A:
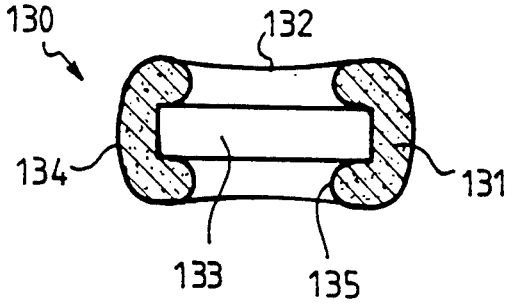
FIG. 11 is a set of possible shapes of a package according to the invention.

In FIG. 11*a*, the package 130 comprises principally a heat-shrinkable sheet that has been installed around the unit comprising the bolster 131, 134 and the product to be packaged 132. The bolster 131, 134 is made of separate or joined cushions 131 and 134, squashed by the shrinking of the film 132 around the product 133.

Figure 11B:
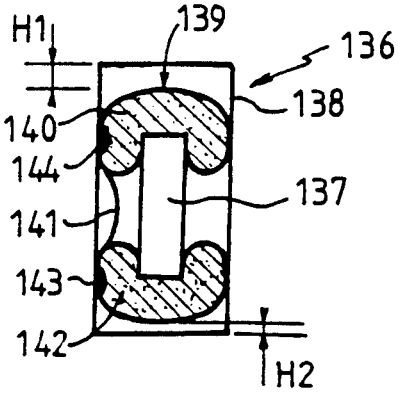

In FIG. 11*b*, the package 136 includes a cardboard box 138 on the inside of which the group comprising the bolster 139, and the packaged product 137, has been suspended, at heights H1 and H2 on the other side of the walls of the box 138. Here, the bolster 139 comprises two cushions 140 and 142, joined by a flat section 141. The lateral pressure exerted by the closure of the box maintains the enveloping shape of each cushion around the product. The cushions 140 and 142 are kept suspended in the box 138 by placing adhesive 143 and 144 there, before the unit comprising the product and the bolster is assembled.

I claim:

1. A bolster for holding and protecting a product in a package, characterized in that the bolster (21) comprises plastic material in a continuous form and of a predetermined axial length so as to at least partially surround the product (19), said bolster having one face, at least one axial groove within which the product is to be received and including retaining portions to each side of the groove for retention of the product in the direction perpendicular to the plane in which the length of the bolster is located, to prevent the product from displacement in the package (18);

wherein said plastic material is a solid material such as polyethylene or polyurethane, said retaining portions and groove being arranged to receive and laterally hold the product (15), and including at least one contact face (8*c*) opposite the groove for bearing against an inside wall of the package (13); and wherein the contact face opposite the face of the bolster carrying the groove (8*a*) is of a mating shape (3) to that of said one face, so as to permit stacking of the bolsters in storage in a nested configuration.

2. A bolster as defined by claim 1, characterized in that it is in the form of a continuous band, said one contact face forming a lower portion intended to come into contact wit the inside walls of the package (13) and means for pivoting portion of the band to facilitate its being folded about and surrounding the product.

3. A bolster as defined by claim 2, characterized in that the pivoting means comprise slits (4 through 6) in the solid material extending inward from said one contact face (3).

4. A bolster for holding and protecting a product in a package, characterized in that the bolster (21) comprises plastic material in a continuous form and of a predetermined axial length so as to at least partially surround the product (19), said bolster having one face, at least one axial groove within which the product is to be received and including retaining portions to each side of the groove for retention of the product in the direction perpendicular to the plane in which the length of the bolster is located, to prevent the product from displacement in the package (18);

wherein said plastic material is a solid material such as polyethylene or polyurethane, said retaining portions and groove being arranged to receive and laterally hold the product (15), and including at least one contact face (8*c*) opposite the groove for bearing against an inside wall of the package (13);

wherein said bolster is in the form of a continuous band, said one contact face forming a lower portion intended to come into contact with the inside walls of the package (13) and means for pivoting a portion of the band to facilitate its being folded about and surrounding the product;

wherein the pivoting means comprise slits (4 through 6) in the solid material extending inward from said one contact face (3); and wherein each slit extends over the entire width of the bolster, and is in the form of a capital 30 T.

5. A bolster as defined by claim 1, characterized in that the groove (91) includes means (92, 93) for receiving fragile unevenness of the product in contact with the bolster (90).

6. A bolster as defined by claim 1, characterized in that the groove (2) and said mating shape (3) are comprised along the entire length of the bolster (1).

* * * * *

UNITED STATES PATENT AND TRADEMARK OFFICE

CERTIFICATE OF CORRECTION

PATENT NO. : 5,060,801

DATED : October 29, 1991

INVENTOR(S) : Jean-Claude VILAS-BOAS

It is certified that error appears in the above-identified patent and that said Letters Patent is hereby corrected as shown below:

Col. 8, line 6 (Claim 2, line 4) "wit" should be -- with --.

Col. 8, line 40 (Claim 4, line 28) delete "30".

Signed and Sealed this

Twenty-first Day of September, 1993

Bruce Lehman

*Attest:*

BRUCE LEHMAN

*Attesting Officer*

*Commissioner of Patents and Trademarks*